US007104320B2

(12) United States Patent
Buchanan et al.

(10) Patent No.: US 7,104,320 B2
(45) Date of Patent: Sep. 12, 2006

(54) METHOD OF OPTIMIZING PRODUCTION OF GAS FROM SUBTERRANEAN FORMATIONS

(75) Inventors: Larry J. Buchanan, Flower Mound, TX (US); S. Dana Weida, Carrollton, TX (US); Don P. Russell, Plano, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 160 days.

(21) Appl. No.: 10/727,454

(22) Filed: Dec. 4, 2003

(65) Prior Publication Data

US 2005/0121193 A1 Jun. 9, 2005

(51) Int. Cl.
*E21B 43/26* (2006.01)
*E21B 43/30* (2006.01)
*E21B 49/00* (2006.01)

(52) U.S. Cl. ..... 166/245; 166/250.01; 166/250.1; 166/308.1; 175/62

(58) Field of Classification Search ..... 166/250.01, 166/254.2, 50, 245, 297, 298, 308.1; 175/61, 175/62
See application file for complete search history.

(56) References Cited

U.S. PATENT DOCUMENTS 5,499,678 A 3/1996 Surjaatmadja et al. ..... 166/298
5,547,023 A * 8/1996 McDaniel et al. ..... 166/280.1
5,765,642 A 6/1998 Surjaatmadja ..... 166/297
5,894,888 A * 4/1999 Wiemers et al. ..... 166/250.1
6,024,171 A * 2/2000 Montgomery et al. ... 166/308.1
6,280,000 B1 8/2001 Zupanick ..... 299/12
6,425,448 B1 * 7/2002 Zupanick et al. ..... 175/61
6,591,903 B1 * 7/2003 Ingle et al. ..... 166/50
6,604,580 B1 8/2003 Zupanick et al. ..... 166/245
2002/0170712 A1 * 11/2002 Milne et al. ..... 166/254.2
2003/0062198 A1 * 4/2003 Gardes ..... 175/61
2003/0150263 A1 * 8/2003 Economides et al. .... 73/152.48

* cited by examiner

*Primary Examiner*—George Suchfield
(74) *Attorney, Agent, or Firm*—Robert A. Kent; Baker Botts

(57) ABSTRACT

The present invention relates generally to subterranean well construction, and more particularly, to improved methods for producing gas from subterranean formations that include coal seams. The method according to the present invention includes the steps of drilling at least one substantially vertical well bore intersecting the coal seam, drilling at least one substantially horizontal well bore disposed substantially within the coal seam and exiting from the at least one substantially vertical well bore, and fracturing the coal seam along the at least one substantially horizontal well bore using a hydrajetting tool to produce a plurality of fractures. The plurality of fractures is spaced to maximize interference between the fractures and enhances the production of gas from the coal seam of the subterranean formation. A plurality of substantially horizontal well bores can also be drilled. The plurality of substantially horizontal well bores can be spaced to maximize interference between the substantially horizontal well bores.

39 Claims, 3 Drawing Sheets

METHOD OF OPTIMIZING PRODUCTION OF GAS FROM SUBTERRANEAN FORMATIONS

CROSS REFERENCE TO RELATED APPLICATIONS

The present invention is related to U.S. Ser. No. 10/727,453 entitled, "Method of Optimizing Production of Gas from Subterranean Formations" filed on even date herewith, which is assigned to the assignee of the present invention.

FIELD OF THE INVENTION

The present invention relates generally to subterranean well construction, and more particularly, to improved methods for producing gas from subterranean formations that include coal seams.

BACKGROUND OF THE INVENTION

Subterranean formations that include coal seams can contain substantial quantities of methane gas. Extracting this gas may help protect mining personnel from dangerous exposures to methane and may allow the producer to derive profit from sale of the gas as an energy source. While conventional reservoirs store methane as a free gas under pressure, coal's unique structure allows it also to store gas through adsorption onto its surface. The gas adsorbs into micropores that dot the surface of coal. The high density of these micropores yields 10 to 100 square meters of surface area per gram of coal, giving coal beds the capacity to adsorb significant amounts of gas. The amount of gas a particular coal bed can store depends on the interplay of several factors other than its structural properties, such as the temperature and pressure of the reservoir, the composition of the coal, and the composition and molecular properties of the gas.

Generally, the closer wells are spaced, the greater gas recovery may be over the economic life of the wells. Wells are ideally spaced to maximize gas liberation by minimizing the reservoir pressure in the coal seam across a large area. Because coal stores gas by adsorption, producers must depressurize coal beds to desorb the gas from the coal to begin gas flow. The lower reservoir pressure allows the gas to diffuse out of the coal. A reduction in reservoir pressure can be achieved by spacing many wells in close proximity, with the actual distance between each well determined by the permeability of the coal seam, among other factors. The production of gas by one well will reduce the pressure in the reservoir and affect production by neighboring wells. This well "interference" is determined by a number of factors, including, but not limited to, permeability, permeability anisotropy and well spacing. By spacing wells to maximize interference, coal beds can be rapidly depressurized to stimulate gas flow. Wells are spaced to yield maximum interference within four to six years to allow for maximum production within an economic time frame. Because subterranean water often accompanies methane gas in coal seams, reservoir pressure can also be reduced by removing this water while preventing localized water recharge. The less distance a water or gas molecule must travel to a well, the greater production will be within the economic time frame of the wells. Well spacing is therefore a critical design element in any gas production system.

Horizontal wells allow for close well spacing without the high cost and negative environmental impact of drilling closely spaced vertical wells. Members of the mining industry have produced methane from coal beds for years with horizontal wells rather than with vertical wells alone. Horizontal wells used to produce methane have been drilled as branches of well bores that are initiated at the depth of the coal seam from vertical mine shafts or well bores. The horizontal wells have been drilled in patterns that require drilling extensive networks of horizontal well bores, such as pinnate patterns. However, while drilling extensive networks of horizontal well bores in coal seams may be cheaper than drilling a multitude of closely spaced vertical wells alone, doing so may still be economically infeasible. The more drilling a project requires, the more costly and time-consuming it will be. Although horizontal wells of the prior art reduced the number of vertical wells needed to extract methane from coal beds, the prior art still requires drilling multiple vertical wells. Depending on the characteristics of the formation, seam and site, these vertical wells may need to be spread over entire the surface of a coal seam if prior art patterns are used.

Well bore instability limits the applicability of prior art horizontal well systems more than the characteristics of a particular reservoir. Horizontal well systems of the prior art have provided for open hole operation. That is, the horizontal well bores have lacked linings or casings. Collapses of unlined and uncased well bores in coal seams are quite common, as coal seams often do not have the strength to withstand extensive open hole operations. Fracturing open hole well bores in coal seams can be particularly hazardous. Linings and casings increase well bore stability and thus are generally desirable. However, as with drilling, lining or casing extensive networks of horizontal wells can be prohibitively expensive.

SUMMARY OF THE INVENTION

The present invention relates generally to subterranean well construction, and more particularly, to improved methods for producing gas from subterranean formations that include coal seams.

The present invention is directed to a method for producing a gas from a subterranean formation including a coal seam. The method according to the present invention includes the steps of drilling at least one substantially vertical well bore intersecting the coal seam, drilling at least one substantially horizontal well bore disposed substantially within the coal seam and exiting from the at least one substantially vertical well bore, and fracturing the coal seam along the at least one substantially horizontal well bore using a hydrajetting tool to produce a plurality of fractures. The plurality of fractures is spaced to maximize interference between the fractures and enhances the production of gas from the coal seam of the subterranean formation.

In another embodiment according to the present invention, a plurality of substantially horizontal well bores is drilled. The plurality of substantially horizontal well bores is disposed substantially within the coal seam and exits from the at least one substantially vertical well bore. The plurality of substantially horizontal well bores is spaced to maximize interference between the substantially horizontal well bores. Again, the plurality of fractures is spaced to maximize interference between the fractures and enhances the production of gas from the coal seam of the subterranean formation.

In another embodiment according to the present invention, the subterranean formation is logged by inserting logging equipment into the at least one substantially vertical well bore, and the at least one substantially vertical well bore is cased. The plurality of substantially horizontal well bores is lined or cased. As with the previous embodiment, the plurality of substantially horizontal well bores is spaced to maximize interference between the substantially horizontal well bores. The plurality of fractures enhances the production of gas from the coal seam of the subterranean formation.

In another embodiment according to the present invention, the plurality of fractures is spaced to maximize interference between fractures and enhances the production of gas from the coal seam of the subterranean formation. As with the previous embodiment, the subterranean formation is logged by inserting logging equipment into the at least one substantially vertical well bore, and the at least one substantially vertical well bore is cased. The plurality of substantially horizontal well bores is lined or cased. Again, the plurality of substantially horizontal well bores is spaced to maximize interference between the substantially horizontal well bores.

In another embodiment according to the present invention, the plurality of substantially horizontal well bores forms at least one fork pattern. Furthermore, the plurality of substantially horizontal well bores is spaced to maximize interference between the substantially horizontal well bores. The plurality of fractures is spaced to maximize interference between fractures and enhances the production of gas from the coal seam of the subterranean formation.

In yet another embodiment according to the present invention, the plurality of substantially horizontal well bores forms a radial pattern. Again, the plurality of substantially horizontal well bores is spaced to maximize interference between the substantially horizontal well bores. The plurality of fractures is spaced to maximize interference between fractures and enhances the production of gas from the coal seam of the subterranean formation.

In another embodiment according to the present invention, a method for producing gas from a subterranean formation, wherein the subterranean formation includes a coal seam, comprises the steps of: optimizing a number, placement and size of a plurality of fractures in the subterranean formation so as to determine a maximum interference spacing between the plurality of fractures by (a) determining one or more geomechanical stresses induced by each fracture based on the dimensions and location of each fracture, (b) determining a geomechanical maximum number of fractures based on the geomechanical stresses induced by each of the fractures, and (c) determining a predicted stress field based on the geomechanical stresses induced by each fracture; drilling at least one substantially vertical well bore intersecting the coal seam; drilling at least one substantially horizontal well bore disposed substantially within the coal seam and exiting from the at least one substantially vertical well bore; and fracturing the coal seam along the at least one substantially horizontal well bore using a hydrajetting tool to produce the plurality of fractures, wherein the plurality of fractures is spaced according to the maximize interference spacing between the plurality of fractures and wherein the plurality of fractures enhances the production of gas from the coal seam of the subterranean formation.

In another embodiment according to the present invention, a method for producing gas from a subterranean formation, wherein the subterranean formation includes a coal seam, comprises the steps of: optimizing a number, placement and size of a plurality of fractures in the subterranean formation so as to determine a maximum interference spacing between the plurality of fractures by (a) determining one or more geomechanical stresses induced by each fracture based on the dimensions and location of each fracture, (b) determining a geomechanical maximum number of fractures based on the geomechanical stresses induced by each of the fractures, and (c) determining a predicted stress field based on the geomechanical stresses induced by each fracture; drilling at least one substantially vertical well bore intersecting the coal seam; logging the subterranean formation by inserting logging equipment into the at least one substantially vertical well bore; casing the at least one substantially vertical well bore; drilling a plurality of substantially horizontal well bores disposed substantially within the coal seam and exiting from the at least one substantially vertical well bore, wherein the plurality of substantially horizontal well bores is spaced to maximize interference between the substantially horizontal well bores; lining or casing the plurality of substantially horizontal well bores; and fracturing the coal seam along the plurality of substantially horizontal well bores using a hydrajetting tool to produce the plurality of fractures, wherein the plurality of fractures is spaced according to the maximize interference spacing between the plurality of fractures and wherein the plurality of fractures enhances the production of gas from the coal seam of the subterranean formation.

In another embodiment according to the present invention, a method for producing gas from a subterranean formation, wherein the subterranean formation includes a coal seam, comprises the steps of: optimizing a number, placement and size of a plurality of fractures in the subterranean formation so as to determine a maximum interference spacing between the plurality of fractures by (a) determining one or more geomechanical stresses induced by each fracture based on the dimensions and location of each fracture, (b) determining a geomechanical maximum number of fractures based on the geomechanical stresses induced by each of the fractures, and (c) determining a predicted stress field based on the geomechanical stresses induced by each fracture; drilling at least one substantially vertical well bore intersecting the coal seam; logging the subterranean formation by inserting logging equipment into the at least one substantially vertical well bore; casing the at least one substantially vertical well bore; drilling a plurality of substantially horizontal well bores disposed substantially within the coal seam and exiting from the at least one substantially vertical well bore, wherein the plurality of substantially horizontal well bores forms at least one fork pattern; lining or casing the plurality of substantially horizontal well bores; and fracturing the coal seam along the plurality of substantially horizontal well bores using a hydrajetting tool to produce the plurality of fractures, wherein the plurality of fractures is spaced according to the maximize interference spacing between the plurality of fractures and wherein the plurality of fractures enhances the production of gas from the coal seam of the subterranean formation.

In another embodiment according to the present invention, a method for producing gas from a subterranean formation, wherein the subterranean formation includes a coal seam, comprises the steps of: optimizing a number, placement and size of a plurality of fractures in the subterranean formation so as to determine a maximum interference spacing between the plurality of fractures by (a) determining one or more geomechanical stresses induced by each fracture based on the dimensions and location of each fracture, (b) determining a geomechanical maximum number of fractures based on the geomechanical stresses induced by each of the fractures, and (c) determining a predicted stress field based on the geomechanical stresses induced by each fracture; drilling at least one substantially vertical well bore intersecting the coal seam; logging the subterranean formation by inserting logging equipment into the at least one substantially vertical well bore; casing the at least one substantially vertical well bore; drilling a plurality of substantially horizontal well bores disposed substantially within the coal seam and exiting from the at least one substantially vertical well bore, wherein the plurality of substantially horizontal well bores forms a radial pattern; lining or casing the plurality of substantially horizontal well bores; and fracturing the coal seam along the plurality of substanjially horizontal well bores using a hydrajetting tool to produce the plurality of fractures, wherein the plurality of fractures is spaced according to the maximize interference spacing between the plurality of fractures and wherein the plurality of fractures enhances the production of gas from the coal seam of the subterranean formation.

The step of optimizing a number, placement and size of a plurality of fractures may occur before the step of fracturing the coal seam. Other embodiments according to the present invention may include one or more of the following steps: determining a cost-effective number of fractures; determining an optimum number of fractures, where the optimum number of fractures is the maximum cost-effective number of fractures that does not exceed the geomechanical maximum number of fractures; spacing the fractures a uniform distance from each other; creating the fractures with a uniform size. Additionally, steps (a), (b), and (c) in each of the above embodiments, may be repeated after each fracture is created. Further, the repeating step may comprise the steps of gathering and analyzing real-time fracturing data for each fracture created. In certain embodiments, methods that include the gathering of real-time fracturing data may comprise the steps of: (i) measuring a fracturing pressure while creating a current fracture; (ii) measuring a fracturing rate while creating the current fracture; and (iii) measuring a fracturing time while creating the current fracture. In certain embodiments, the measuring of fracturing pressure may be accomplished by using one or more transducers located at a wellhead of the at least one substantially vertical well bore, the measuring of fracturing pressure may be accomplished using one or more transducers located down hole, and the fracturing pressure is measured in a tubing. It is further recognized that the analyzing of real-time fracturing data may comprise the steps of: determining a new stress field, based on the real-time fracturing data; and comparing the new stress field with the predicted stress field. Certain embodiments may further comprise one or more of the following steps: the step of decreasing the number of fractures in response to the real-time fracturing data; the step of increasing the distance between the fractures in response to the real-time fracturing data; and the step of adjusting the size of the fractures in response to the real-time fracturing data.

The features and advantages of the present invention will be readily apparent to those skilled in the art upon a reading of the description of the preferred embodiments that follows.

BRIEF DESCRIPTION OF THE DRAWINGS

A more complete understanding of the present disclosure and advantages thereof may be acquired by referring to the following description taken in conjunction with the accompanying drawings, wherein.

Figure 1:
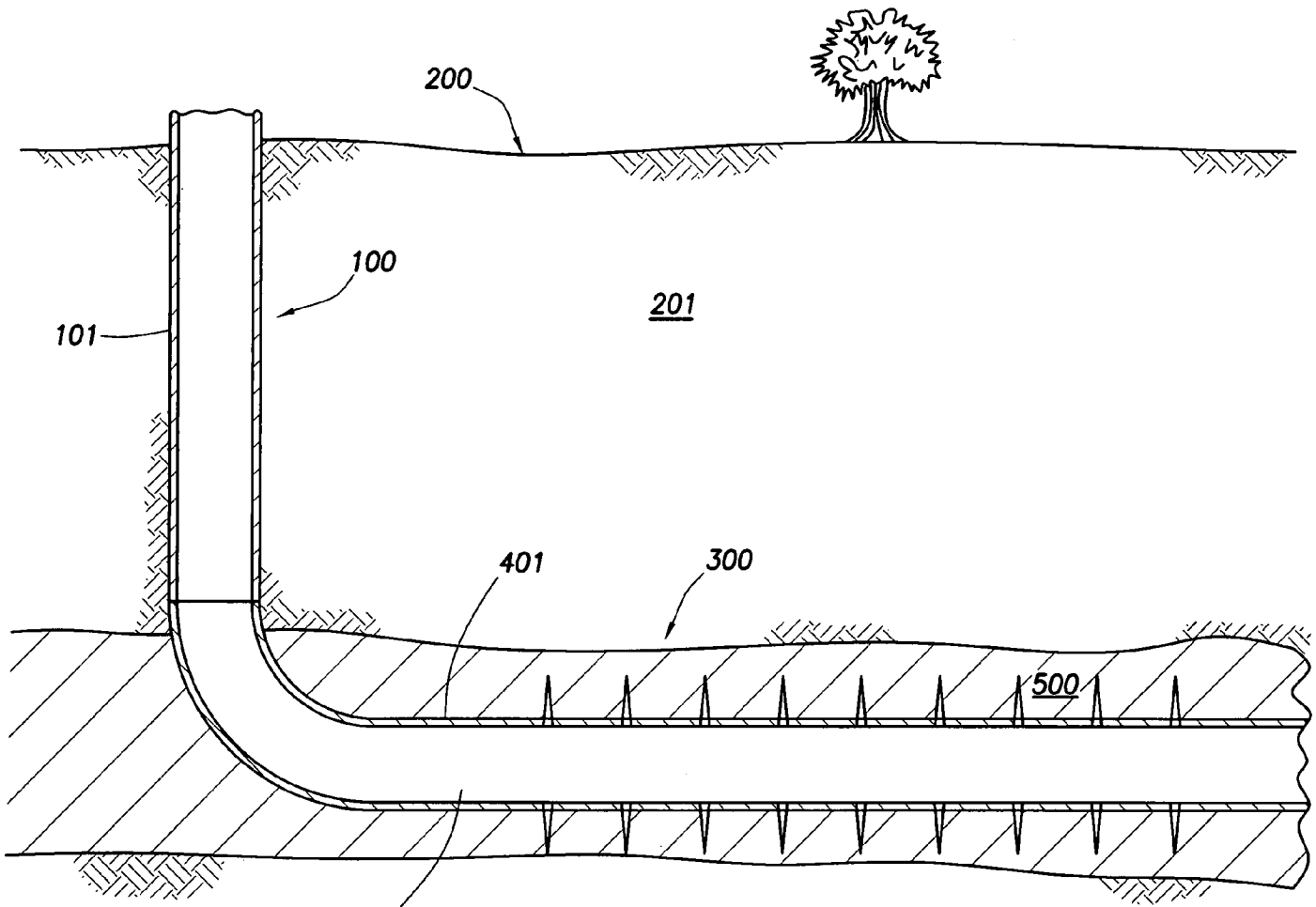
FIG. 1 illustrates a cross-sectional side view of initial steps of an exemplary embodiment of the methods of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present invention relates generally to subterranean well construction, and more particularly, to improved methods for producing gas from subterranean formations that include coal seams. FIG. 1 depicts initial steps of an exemplary embodiment of the present invention. At least one substantially vertical well is drilled into a subterranean formation such that the at least one substantially vertical well bore intersects with one or more coal seams. An exemplary substantially vertical well bore 100, shown in FIG. 1, is drilled from the surface 200 through subterranean formation 201 using prior art techniques. Subterranean formation 201 includes coal seam 300, which is the source of a gas. The number of substantially vertical well bores necessary to maximize gas production will depend on several factors, including, but not limited to, the characteristics and limitations of the site, subterranean formation, and coal seam. In particular, the permeability of the subterranean formation and coal seam will be relevant to determining the number of vertical wells necessary. Ideally, the number of substantially vertical well bores should be limited to as few as possible to minimize both expense and impact on the surface. The suitable number of substantially vertical well bores will also depend on the particular embodiment of the subsequent steps of the methods of the present invention, as will be discussed later in this disclosure. A suitable number of substantially vertical well bores will be apparent to a person of ordinary skill in the art having the benefit of this disclosure.

In an exemplary embodiment of the present invention, the at least one substantially vertical well bore terminates at or above coal seam 300, as does the exemplary substantially vertical well bore 100 shown in FIG. 1. Prior art logging equipment may be inserted in the at least one substantially vertical well bore after drilling to gather information about the characteristics of the subterranean formation. Alternatively, prior art measurement-while-drilling (MWD) tools may be used. In an exemplary embodiment not shown in FIG. 1, the at least one substantially vertical well bore terminates below the coal seam. Again, prior art logging equipment or MWD tools may be used in the at least one substantially vertical well bore if it terminates below coal seam. However, before the next steps of the exemplary embodiment are performed, any substantially vertical well bore that terminates below the coal seam should be plugged at or above the coal seam using methods known to persons ordinarily skilled in the art. Casing 101 may be inserted and cemented into the at least one substantially vertical well bore, as shown in FIG. 1.

In an exemplary embodiment, at least one substantially horizontal well bore is drilled substantially within the coal seam. As used herein, "substantially horizontal" with respect to a well bore shall be understood to include sloped, undulated, or other inclinations as necessary for the well bore to remain substantially within the coal seam. If only one substantially vertical well bore has been drilled, the at least one substantially horizontal well bore will exit from that substantially vertical well bore. However, if more than one substantially vertical well bore has been drilled, each substantially vertical well bore should connect to at least one substantially horizontal well bore. The specific configuration and number of substantially horizontal well bores will depend on several factors, including, but not limited to, the characteristics and limitations of the site, subterranean formation, and coal seam. The proper configuration and number of substantially horizontal well bores will be apparent to a person of ordinary skill in the art having the benefit of this disclosure.

An exemplary substantially horizontal well bore is shown in FIG. 1 labeled with the numeral 400. The at least one substantially horizontal well bore should be disposed substantially within the coal seam 300, as shown by the exemplary substantially horizontal well bore 400, to enhance the production of gas from the coal seam. In an exemplary embodiment, the at least one substantially horizontal well bore may be drilled using a combination of drilling techniques and apparatuses known to persons of ordinary skill in the art. Such apparatuses may include, but are not limited to, an articulated drill string and a motor and bit suitable for downhole use.

The at least one substantially horizontal well bore may be cased or lined using prior techniques and apparatuses in conjunction with a prior art casing or liner. As is known to persons of ordinary skill in the art, casing and liners impart a greater resistance to collapse and are therefore desirable. Casings or liners are warranted in coal seams, which are particularly susceptible to collapse. Because fewer substantially horizontal well bores are necessary in the present invention, as will be discussed later in this disclosure, casing or lining the at least one substantially horizontal well bore is less costly in the present invention. It may therefore be possible to line or case the at least one substantially horizontal well bore in the present invention where prior art methods would have made casings or linings infeasible. An exemplary liner 401 is shown inside exemplary substantially horizontal well bore 400 in FIG. 1. The liner may or may not be cemented to the at least one substantially horizontal well bore.

In an exemplary embodiment, a plurality of fractures in the coal seam is created along the at least one substantially horizontal well bore. FIG. 1 shows an exemplary plurality of fractures, denoted generally by the numeral 500, created along the exemplary substantially horizontal well bore 400. Once the fracturing is complete, any equipment and fluid contained within the at least one substantially vertical well bore and at least one substantially horizontal well bore may be removed and the final preparations necessary for gas production may begin. If present, water may be removed from the coal seam using prior art water removal methods.

Use of a fracturing technique may provide for an advantage over prior art methods that use drilling alone. Drilling takes much more time and can be much more expensive than fracturing. If the fractures are spaced to maximize interference, they can provide adequate coverage of coal seams without drilling more substantially horizontal well bores. The suitable number, placement and size of fractures for a particular well bore are determined in part by the geomechanical stresses present in the formation. Pending application U.S. Ser. No. 10/728,295, titled "Methods for Geomechanical Fracture Modeling," assigned to the same assignee of this patent, discloses a method for designing and optimizing the number, placement, and size of fractures in a subterranean formation. The inventors of the present invention incorporate the disclosure of that application herein. The number of fractures that form the plurality of fractures 500, their spacing and their configuration will depend on several factors, including, but not limited to, the characteristics and limitations of the site, subterranean formation, and coal seam and will be apparent to persons of ordinary skill in the art having the benefit of the present disclosure and the disclosure of the application for "Methods for Geomechanical Fracture Modeling" incorporated herein.

The plurality of fractures 500 may be created using prior art fracturing techniques and apparatuses. In certain preferred embodiments, the plurality of fractures 500 may be created using a hydrajetting tool such as the SurgiFrac™ tool made by Halliburton. Hydrajetting tools and methods for their use are disclosed in U.S. Pat. Nos. 5,499,678 and 5,765,642, which are herein incorporated by reference. Use of a hydrajetting tool eliminates the need to mechanically isolate the well formation during fracturing. The hydrajetting tool has at least one fluid-jet-forming nozzle that ejects fluid at a pressure sufficient to first form a cavity in a well bore surface and then fracture the surrounding formation by stagnation pressure in the cavity. An exemplary embodiment of the hydrajetting tool will have a plurality of fluid-jet-forming nozzles aligned in a single plane. If the plurality of fluid-jet-forming nozzles of the hydrajetting tool is aligned with the plane of maximum principal stress in the formation to be fractured, a single fracture can be created at that precise location. In certain preferred embodiments of the present invention, the hydrajetting tool is inserted into the at least one substantially horizontal well bore and positioned where fracturing is desired. The hydrajetting tool jets fluid containing a suitable prior art proppant to fracture the coal seam at that position. This procedure is repeated to produce the plurality of fractures 500.

Figure 2:
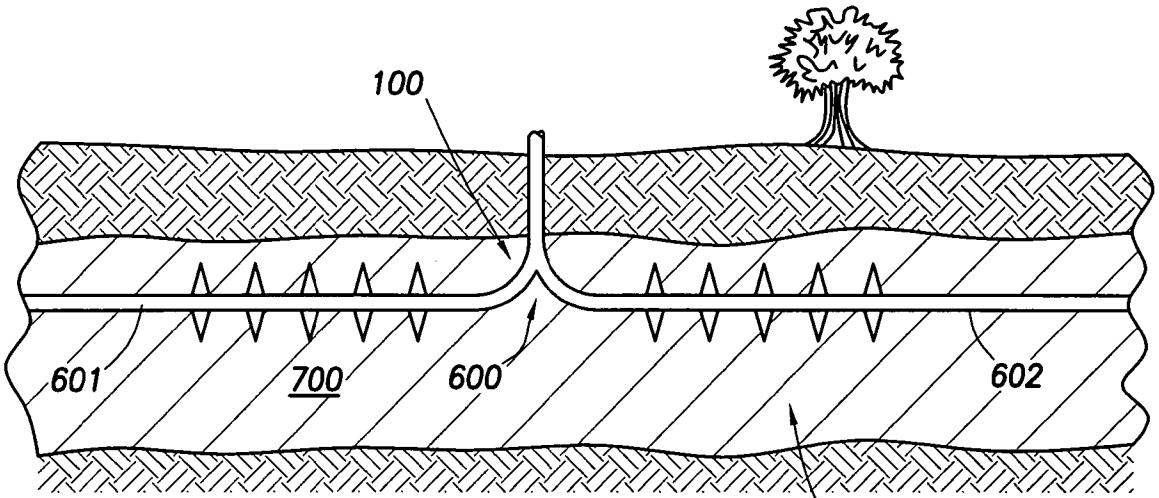
FIG. 2 illustrates a cross-sectional side view of a pattern of substantially horizontal well bores used in an exemplary embodiment of the present invention.
Figure 3:
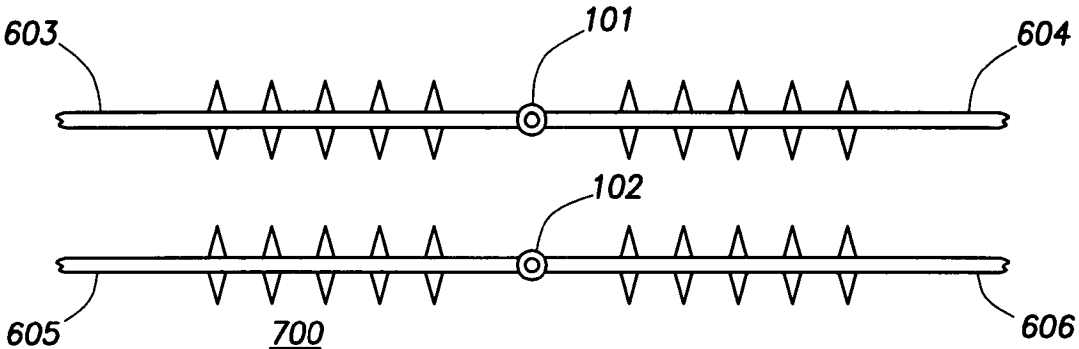
FIG. 3 illustrates a top view of a pattern of substantially horizontal well bores used in an exemplary embodiment of the present invention.

In a certain preferred embodiment, a plurality of substantially horizontal well bores is drilled substantially within the coal seam. The plurality of substantially horizontal well bores forms one of various patterns designed to maximize gas production from the coal seam. A cross-sectional side view of such a pattern is given in FIG. 2. In an exemplary embodiment, a single substantially vertical well bore 100 is located in the center of the pattern and intersects with coal seam 300. Two opposed substantially horizontal well bores 601 and 602 disposed substantially within coal seam 300 form the plurality of substantially horizontal well bores, denoted generally by the numeral 600, in this embodiment. A plurality of fractures 700 is distributed along the substantially horizontal well bores 601 and 602. FIG. 3 depicts a top view of an exemplary embodiment that combines two embodiments of the pattern shown in FIG. 2. Any number of the pattern shown in FIG. 2 may be combined as needed to properly produce gas from a particular coal seam. A suitable number of embodiments of the pattern of the embodiment in FIG. 2 will be apparent to persons of ordinary skill in the art having the benefit of this disclosure.

In the exemplary embodiment shown in FIG. 3, two substantially vertical well bores 101 and 102 support two substantially horizontal well bores 603 and 604, and 605 and 606, respectively. The substantially horizontal well bores 603, 604, 605, and 606 are parallel. This parallel configuration can allow for peak interference along the length of the substantially horizontal well bores to be reached within one to four years. Accordingly, gas production can be maximized within a feasible economic time frame. The plurality of fractures 700 should be spaced such that the interference between neighboring fractures is maximized. The number, spacing and configuration of substantially vertical well bores and substantially horizontal well bores necessary in the pattern will depend on several factors, including, but not limited to, the characteristics and limitations of the site, subterranean formation, and coal seam and will be apparent to a person of ordinary skill in the art having the benefit of this disclosure. The number of fractures that form the plurality of fractures 700, their spacing and their configuration will depend on similar factors and will be apparent to persons of ordinary skill in the art having the benefit of the present disclosure and the disclosure of the pending application U.S. Ser. No. 10/728,295, titled "Methods for Geomechanical Fracture Modeling," incorporated herein.

Figure 4:
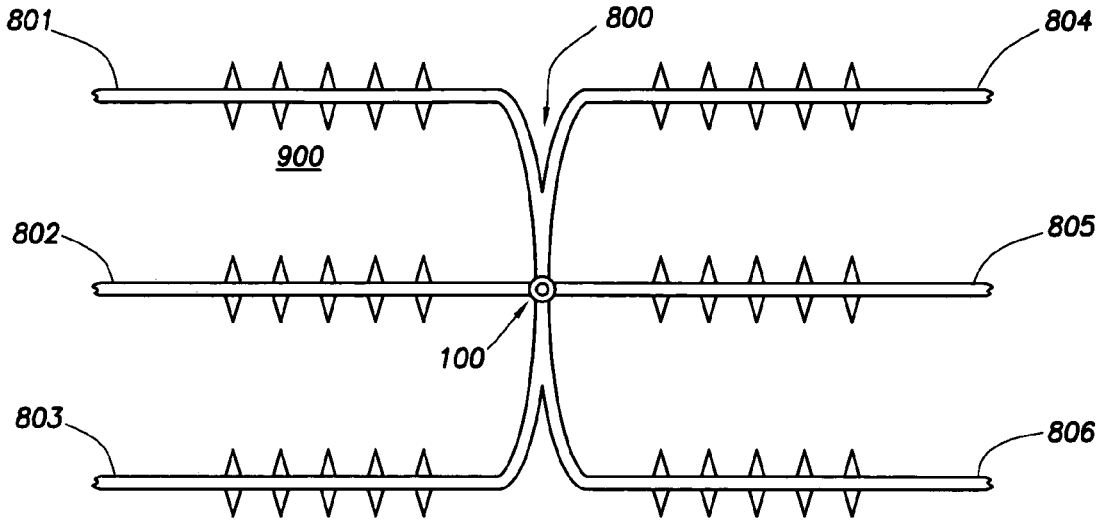
FIG. 4 illustrates a top view of a pattern of substantially horizontal well bores used in an exemplary embodiment of the present invention.

FIG. 4 illustrates a top view of another pattern used in certain preferred embodiments of the present invention. A single substantially vertical well bore 100 is located in the center of the pattern. The plurality of substantially horizontal well bores, denoted generally by the numeral 800, exit the substantially vertical well bore 100 in a pattern of opposed forks. Alternatively, a plurality of substantially vertical well bores may be located in the center of the pattern. One or more of the substantially horizontal well bores that form the plurality of substantially horizontal well bores 800 may exit from each of the substantially vertical well bores that form the plurality of substantially vertical well bores. In one exemplary embodiment, each substantially horizontal well bore connects with a single substantially vertical well bore. The number of substantially vertical well bores and substantially horizontal well bores necessary will depend on a number of factors, including, but not limited to, the characteristics and limitations of the site, subterranean formation and coal seam and will be apparent to persons of ordinary skill in the art having the benefit of this disclosure. However, if a plurality of substantially vertical well bores is deemed necessary, the opposed fork pattern allows for a minimized impact on the surface land because all of the substantially vertical well bores are localized in a small area in the center of the pattern.

Substantially horizontal well bores 801, 802, 803, 804, 805, and 806 form the plurality of substantially horizontal well bores 800 and are disposed substantially within the coal seam. A plurality of fractures 900 is distributed along each of the substantially horizontal well bores 801 through 806. While FIG. 4 may illustrate six substantially horizontal well bores, the number of substantially horizontal well bores that form the plurality is not limited to six. Instead, any number of substantially horizontal well bores may be used as determined by several factors, including, but not limited to, the characteristics and limitations of the site, subterranean formation, and coal seam aid will be apparent to persons of ordinary skill in the art. Alternatively, in an exemplary embodiment, only one fork pattern may be necessary. That is, only the substantially horizontal well bores on one side of FIG. 4, such as 801, 802, and 803, may be required. Again, the configuration will depend on several factors, including, but not limited to, the characteristics and limitations of the site, subterranean formation, and coal seam and will be apparent to a person of ordinary skill in the art having the benefit of this disclosure. Similarly, any number of fractures may form the plurality of fractures 900 distributed along each of the substantially horizontal well bores. A suitable number of substantially horizontal well bores and fractures will depend on several factors, including, but not limited to, the characteristics and limitations of the site, subterranean formation, and coal seam and will be apparent to persons of ordinary skill in the art having the benefit of this disclosure and the benefit of the disclosure of pending application U.S. Ser. No. 10/728,295, titled "Methods for Geomechanical Fracture Modeling," incorporated herein.

Each substantially horizontal well bore 801, 802, 803, 804, 805, and 806 of the exemplary embodiment shown in FIG. 4 is parallel to the other substantially horizontal well bores that form the plurality. In a certain preferred embodiment, the plurality of substantially horizontal well bores 800 is spaced to maximize interference between the substantially horizontal well bores 801, 802, 803, 804, 805, and 806. Maximizing interference maximizes gas production by reducing reservoir pressure in the coal seam across a large area. By spacing the substantially horizontal well bores to maximize interference, fewer substantially horizontal well bores are needed to cover properly drain a coal seam than prior art methods that do not maximize interference require. The pattern of opposed forks allows for maximum interference between wells without distributing a large number of substantially vertical well bores widely over the coal seam. The surface area disturbed by substantially vertical well bores in the pattern of opposed forks is therefore minimized, and the cost and impact on the surface are accordingly minimized. The plurality of fractures may be spaced to maximize interference between neighboring fractures. Again, the proper spacing of the substantially horizontal well bores and fractures will be apparent to persons of ordinary skill in the art having the benefit of this disclosure and the benefit of the disclosure of pending application U.S. Ser. No. 10/728,295, titled "Methods for Geomechanical Fracture Modeling," incorporated herein.

Figure 5:
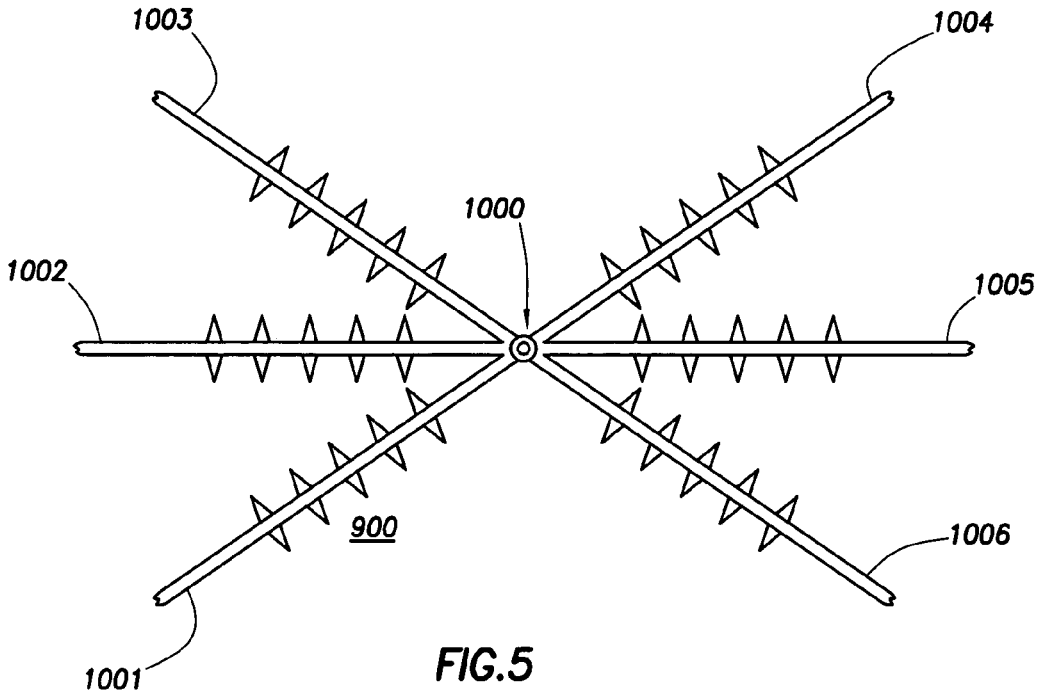
FIG. 5 illustrates a top view of a pattern of substantially horizontal well bores used in an exemplary embodiment of the present invention.

FIG. 5 depicts a top view of a pattern used in an exemplary embodiment of the present invention. In this configuration, the plurality of substantially horizontal well bores, denoted generally by the numeral 1000, exit radially from at least one substantially vertical well bore. Substantially horizontal well bores 1001, 1002, 1003, 1004, 1005, and 1006 form the plurality of substantially horizontal well bores 1000. A plurality of fractures 900 are disposed along each of the substantially horizontal well bores 1001, 1002, 1003, 1004, 1005, and 1006. A radial pattern forming a semi-circle may be sufficient to drain a particular site. Therefore, in one exemplary embodiment, only substantially horizontal well bores 1001, 1002 and 1003 are used. As with the fork pattern, the proper number and configuration of substantially horizontal well bores and fractures will depend on several factors, including, but not limited to, the characteristics and limitations of the site, subterranean formation, and coal seam and will be apparent to persons of ordinary skill in the art having the benefit of this disclosure and the benefit of the disclosure of pending application U.S. Ser. No. 10/728,295, titled "Methods for Geomechanical Fracture Modeling," incorporated herein.

In an exemplary embodiment depicted in FIG. 5, each of the substantially horizontal well bores 1001, 1002, 1003, 1004, 1005, and 1006 that form the plurality of substantially horizontal well bores 1000 exits from a single substantially vertical well bore. In an alternative exemplary embodiment, the plurality of substantially horizontal well bores 1000 may be divided among several substantially vertical well bores, each substantially vertical well bore having at least one substantially horizontal well bore. Much like the pattern of opposed forks shown in FIG. 4, the radial pattern of FIG. 5 allows for the substantially vertical well bores to be localized in a small area, rather than spread throughout the area of the coal seam. In an exemplary embodiment, the plurality of substantially horizontal well bores and plurality of fractures are spaced to maximize interference.

Therefore, the present invention is well adapted to carry out the objects and attain the ends and advantages mentioned, as well as those that are inherent therein. While the invention has been depicted, described, and is defined by reference to the exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only and are not exhaustive of the invention. Consequently, the invention is intended to be limited only by the spirit and scope of the appended claims, giving full cognizance to equivalents in all respects.

What is claimed is:

1. A method for producing gas from a subterranean formation, wherein the subterranean formation includes a coal seam, comprising the steps of:

optimizing a number, placement and size of a plurality of fractures in the subterranean formation so as to determine a maximum interference spacing between the plurality of fractures by (a) determining one or more geomechanical stresses induced by each fracture based on the dimensions and location of each fracture. (b) determining a geomechanical maximum number of fractures based on the geomechanical stresses induced by each of the fractures, and (c) determining a predicted stress field based on the geomechanical stresses induced by each fracture;

drilling at least one substantially vertical well bore intersecting the coal seam;

drilling at least one substantially horizontal well bore disposed substantially within the coal seam and exiting from the at least one substantially vertical well bore; and fracturing the coal seam along the at least one substantially horizontal well bore using a hydrajetting tool to produce the plurality of fractures, wherein the plurality of fractures is spaced according to the maximize interference spacing between the plurality of fractures and wherein the plurality of fractures enhances the production of gas from the coal seam of the subterranean formation.

2. The method of claim 1, further comprising the step of casing the at least one substantially vertical well bore.

3. The method of claim 1, further comprising the step of casing the at least one substantially horizontal well bore.

4. The method of claim 1, further comprising the step of lining the at least one substantially horizontal well bore.

5. The method of claim 1, further comprising the step of removing water from the coal seam of the subterranean formation.

6. The method of claim 1, further comprising the step of inserting logging equipment into the at least one substantially vertical well bore.

7. The method of claim 1, further comprising the step of inserting logging equipment into the at least one substantially horizontal well bore.

8. The method of claim 1 wherein the at least one substantially vertical well bore terminates at or above the coal seam.

9. The method of claim 1 wherein the at least one substantially vertical well bore terminates below the coal seam.

10. The method of claim 9 further comprising an additional step of plugging the at least one substantially vertical well bore at or above the coal seam before the step of drilling at least one substantially horizontal well bore.

11. The method of claim 1 wherein the step of optimizing a number, placement and size of a plurality of fractures occurs before the step of fracturing the coal seam.

12. The method of claim 1 further comprising the steps of:

determining a cost-effective number of fractures; and determining an optimum number of fractures, where the optimum number of fractures is the maximum cost-effective number of fractures that does not exceed the geomechanical maximum number of fractures.

13. The method according to claim 1, further comprising the step of spacing the fractures a uniform distance from each other.

14. The method according to claim 1, further comprising the step of creating the fractures with a uniform size.

15. The method according to claim 1, further comprising the step of repeating steps (a), (b), and (c) after each fracture is created.

16. The method according to claim 15, wherein the repeating step comprises the steps of gathering and analyzing real-time fracturing data for each fracture created.

17. The method according to claim 16, wherein the gathering of real-time fracturing data comprises the steps of:

(i)measuring a fracturing pressure while creating a current fracture;

(ii)measuring a fracturing rate while creating the current fracture; and (iii) measuring a fracturing time while creating the current fracture.

18. The method according to claim 17, wherein the measuring of fracturing pressure is accomplished using one or more transducers located at a wellhead of the at least one substantially vertical well bore.

19. The method of claim 17, wherein the measuring of fracturing pressure is accomplished using one or more transducers located down hole.

20. The method according to claim 17, wherein the fracturing pressure is measured in a tubing.

21. The method according to claim 16, wherein analyzing of real-time fracturing data comprises the steps of:

determining a new stress field, based on the real-time fracturing data; and comparing the new stress field with the predicted stress field.

22. The method according to claim 21, further comprising the step of decreasing the number of fractures in response to the real-time fracturing data.

23. The method according to claim 21, further comprising the step of increasing the distance between the fractures in response to the real-time fracturing data.

24. The method according to claim 21, further comprising the step of adjusting the size of the fractures in response to the real-time fracturing data.

25. A method for producing gas from a subterranean formation, wherein the subterranean formation includes a coal seam, comprising the steps of:

optimizing a number, placement and size of a plurality of fractures in the subterranean formation so as to determine a maximum interference spacing between the plurality of fractures by (a) determining one or more geomechanical stresses induced by each fracture based on the dimensions and location of each fracture. (b) determining a geomechanical maximum number of fractures based on the geomechanical stresses induced by each of the fractures, and (c) determining a predicted stress field based on the geomechanical stresses induced by each fracture;

drilling at least one substantially vertical well bore intersecting the coal seam;

logging the subterranean formation by inserting logging equipment into the at least one substantially vertical well bore;

casing the at least one substantially vertical well bore;

drilling a plurality of substantially horizontal well bores disposed substantially within the coal seam and exiting from the at least one substantially vertical well bore, wherein the plurality of substantially horizontal well bores is spaced to maximize interference between the substantially horizontal well bores;

lining or casing the plurality of substantially horizontal well bores; and fracturing the coal seam along the plurality of substantially horizontal well bores using a hydrajetting tool to produce the plurality of fractures, wherein the plurality of fractures is spaced according to the maximize interference spacing between the plurality of fractures and wherein the plurality of fractures enhances the production of gas from the coal seam of the subterranean formation.

26. The method of claim 25, further comprising the step of removing water from the coal seam of the subterranean formation.

27. The method of claim 25 wherein the at least one substantially vertical well bore terminates at or above the coal seam.

28. The method of claim 25 wherein the at least one substantially vertical well bore terminates below the coal seam.

29. The method of claim 28 further comprising an additional step of plugging the at least one substantially vertical well bore at or above the coal seam before the step of drilling the plurality of substantially horizontal well bores.

30. A method for producing gas from a subterranean formation, wherein the subterranean formation includes a coal seam, comprising the steps of:

optimizing a number, placement and size of a plurality of fractures in the subterranean formation so as to determine a maximum interference spacing between the plurality of fractures by (a) determining one or more geomechanical stresses induced by each fracture based on the dimensions and location of each fracture. (b) determining a geomechanical maximum number of fractures based on the geomechanical stresses induced by each of the fractures, and (c) determining a predicted stress field based on the geomechanical stresses induced by each fracture;

drilling at least one substantially vertical well bore intersecting the coal seam;

logging the subterranean formation by inserting logging equipment into the at least one substantially vertical well bore;

casing the at least one substantially vertical well bore;

drilling a plurality of substantially horizontal well bores disposed substantially within the coal seam and exiting from the at least one substantially vertical well bore, wherein the plurality of substantially horizontal well bores forms at least one fork pattern;

lining or casing the plurality of substantially horizontal well bores; and fracturing the coal seam along the plurality of substantially horizontal well bores using a hydrajetting tool to produce the plurality of fractures, wherein the plurality of fractures is spaced according to the maximize interference spacing between the plurality of fractures and wherein the plurality of fractures enhances the production of gas from the coal seam of the subterranean formation.

31. The method of claim 30, further comprising the step of removing water from the coal seam of the subterranean formation.

32. The method of claim 30 wherein the at least one substantially vertical well bore terminates at or above the coal seam.

33. The method of claim 30 wherein the at least one substantially vertical well bore terminates below the coal seam.

34. The method of claim 33 further comprising an additional step of plugging the at least one substantially vertical well bore at or above the coal seam before the step of drilling the plurality of substantially horizontal well bores.

35. A method for producing gas from a subterranean formation, wherein the subterranean formation includes a coal seam, comprising the steps of:

optimizing a number, placement and size of a plurality of fractures in the subterranean formation so as to determine a maximum interference spacing between the plurality of fractures by (a) determining one or more geomechanical stresses induced by each fracture based on the dimensions and location of each fracture. (b) determining a geomechanical maximum number of fractures based on the geomechanical stresses induced by each of the fractures, and (c) determining a predicted stress field based on the geomechanical stresses induced by each fracture;

drilling at least one substantially vertical well bore intersecting the coal seam;

logging the subterranean formation by inserting logging equipment into the at least one substantially vertical well bore;

casing the at least one substantially vertical well bore;

drilling a plurality of substantially horizontal well bores disposed substantially within the coal seam and exiting from the at least one substantially vertical well bore, wherein the plurality of substantially horizontal well bores forms a radial pattern;

lining or casing the plurality of substantially horizontal well bores; and fracturing the coal seam along the plurality of substantially horizontal well bores using a hydrajetting tool to produce the plurality of fractures, wherein the plurality of fractures is spaced according to the maximize interference spacing between the plurality of fractures and wherein the plurality of fractures enhances the production of gas from the coal seam of the subterranean formation.

36. The method of claim 35, further comprising the step of removing water from the coal seam of the subterranean formation.

37. The method of claim 35 wherein the at least one substantially vertical well bore terminates at or above the coal seam.

38. The method of claim 35 wherein the at least one substantially vertical well bore terminates below the coal seam.

39. The method of claim 38 further comprising an additional step of plugging the at least one substantially vertical well bore at or above the coal seam before the step of drilling the plurality of substantially horizontal well bores.

* * * * *